US011944141B2

(12) United States Patent
Razdan et al.

(10) Patent No.: US 11,944,141 B2
(45) Date of Patent: Apr. 2, 2024

(54) PROTECTIVE GLOVE AND METHODS OF MAKING AND USE THEREOF

(71) Applicant: CareandWear II, Inc., New York, NY (US)

(72) Inventors: Chaitenya Razdan, New York, NY (US); Rachel Sax Ramos, New York, NY (US); Lucy Jones, New York, NY (US)

(73) Assignee: CareandWear II, Inc., New York, NY (US)

( * ) Notice: Subject to any disclaimer, the term of this patent is extended or adjusted under 35 U.S.C. 154(b) by 168 days.

(21) Appl. No.: 17/048,979

(22) PCT Filed: Apr. 29, 2019

(86) PCT No.: PCT/US2019/029626
§ 371 (c)(1),
(2) Date: Oct. 19, 2020

(87) PCT Pub. No.: WO2019/212961
PCT Pub. Date: Nov. 7, 2019

(65) Prior Publication Data

US 2021/0235796 A1 Aug. 5, 2021

Related U.S. Application Data

(60) Provisional application No. 62/665,312, filed on May 1, 2018.

(51) Int. Cl.
*A41D 19/015* (2006.01)
*A41D 19/00* (2006.01)

(52) U.S. Cl.
CPC ... *A41D 19/01558* (2013.01); *A41D 19/0006* (2013.01)

(58) Field of Classification Search
CPC ..... A41D 19/01558; A41D 19/0006; A41D 19/0017; A41D 19/0013
(Continued)

(56) References Cited

U.S. PATENT DOCUMENTS 1,786,227 A * 12/1930 Bruggeman ..... A41D 19/01 2/158
2,025,357 A * 12/1935 Pagan ..... A41D 19/01505 2/161.6
(Continued)

OTHER PUBLICATIONS

International Search Report and Written Opinion, issued by International Searching Authority in corresponding International Application No. PCT/US2019/029626, dated Jul. 10, 2019.

*Primary Examiner* — Heather Mangine
*Assistant Examiner* — Raquel M. Weis
(74) *Attorney, Agent, or Firm* — ArentFox Schiff LLP

(57) ABSTRACT

A glove having a dorsal portion, the dorsal portion including a first material divided into first and second sections, a fastening device for selectively attaching and detaching the first and second sections of the dorsal portion, and a fastening device gripping feature attached to the fastening device, the glove also having a palmar portion, the palmar portion including at least a section comprising a second material, and a wrist portion attached to the dorsal portion and the palmar portion, wherein the wrist portion is selectively movable between an open and a closed position about a wearer's wrist and includes a wrist opening gripping feature.

15 Claims, 5 Drawing Sheets

(58) Field of Classification Search
USPC ..... 2/159, 16
See application file for complete search history.

(56) References Cited

U.S. PATENT DOCUMENTS 2,268,210 A * 12/1941 Fried ..... A41F 1/06 D2/621
2,318,785 A * 5/1943 Kopplin ..... A41D 19/01 2/158
2,393,171 A * 1/1946 Krupp ..... A41D 19/0055 D29/117.1
2,451,837 A * 10/1948 La Londe ..... A41D 19/01 2/158
2,516,241 A * 7/1950 Mulheran ..... A41F 1/06 2/160
2,549,660 A * 4/1951 Buhl ..... A41F 1/06 2/158
2,602,930 A * 7/1952 Tayler ..... A41D 19/00 2/162
2,653,601 A * 9/1953 Morrison ..... A41D 19/0006 602/64
2,700,159 A * 1/1955 Denburgh ..... A63B 71/146 473/59
3,430,265 A * 3/1969 Mazza ..... A41D 19/02 D2/619
4,021,640 A * 5/1977 Gross ..... H05B 3/342 2/167
D249,749 S * 10/1978 Wanous ..... D2/622
4,615,049 A * 10/1986 Samelian ..... A41D 19/0017 2/163
4,704,743 A * 11/1987 Thornell ..... A41D 19/0013 2/163
4,768,234 A * 9/1988 Yamamoto ..... A41D 19/01523 2/160
4,868,927 A * 9/1989 Bourdeau ..... A41F 1/06 2/920
5,020,161 A * 6/1991 Lewis, Jr. ..... A41D 13/0005 2/164
5,329,639 A * 7/1994 Aoki ..... A63B 71/143 2/161.1
5,444,874 A * 8/1995 Samelian ..... A41D 19/0013 2/917
5,542,125 A * 8/1996 Zuckerwar ..... A41D 19/01529 2/160
5,682,613 A * 11/1997 Dinatale ..... A41D 19/01558 2/168
D397,837 S * 9/1998 Redwood ..... D2/614
6,233,742 B1 * 5/2001 Yungkurth ..... A41D 19/002 2/160
6,678,986 B2 * 1/2004 Roush ..... F41G 1/35 2/161.5
7,086,093 B2 * 8/2006 Carey ..... A41D 19/01529 2/161.6
7,451,496 B2 * 11/2008 Carey ..... A41D 19/01594 2/160
7,721,353 B2 * 5/2010 Saturnio ..... A41D 19/01 2/163
8,464,364 B2 * 6/2013 Hofeldt ..... A41D 19/01523 2/160
8,646,115 B1 * 2/2014 Baunach ..... A41D 19/0013 D29/117.1
9,914,042 B2 * 3/2018 Chorne ..... A41D 13/084
10,117,473 B2 * 11/2018 Sullivan ..... A41D 19/0017
2006/0260022 A1 * 11/2006 Vaughn ..... A41D 19/01 2/163
2007/0000017 A1 * 1/2007 Hofmann ..... A41D 19/01576 2/159
2009/0293176 A1 * 12/2009 Partak ..... A41D 19/0013 2/163
2010/0058513 A1 * 3/2010 Drosihn ..... A41D 19/0058 2/162
2013/0160186 A1 * 6/2013 Favia ..... A41D 19/0013 2/162
2013/0263356 A1 * 10/2013 Jones ..... A63B 71/148 2/163
2013/0283498 A1 * 10/2013 Hewitt ..... A41D 19/0048 2/163
2014/0096306 A1 * 4/2014 Hill ..... A41D 19/0034 2/158
2014/0143925 A1 * 5/2014 Chorne ..... A63B 71/143 2/16
2014/0359916 A1 * 12/2014 Baunach ..... A41D 19/0013 2/163
2016/0128402 A1 * 5/2016 Hewitt ..... A63B 71/141 2/162
2016/0249694 A1 * 9/2016 Sullivan ..... A41D 19/0048 2/158
2016/0366958 A1 * 12/2016 Hochmuth ..... B32B 5/245
2017/0273375 A1 * 9/2017 Tang ..... A41D 19/01
2017/0312615 A1 * 11/2017 Matsumoto ..... A41D 19/0048
2018/0263312 A1 * 9/2018 Chen ..... A41D 19/01

* cited by examiner

PROTECTIVE GLOVE AND METHODS OF MAKING AND USE THEREOF

CROSS-REFERENCE TO RELATED APPLICATIONS

This application is a National Stage Entry of International Patent Application No. PCT/US2019/029626, filed on Apr. 29, 2019, which claims priority to U.S. Provisional Application No. 62/665,312, filed May 1, 2018, the disclosures of which are expressly incorporated herein in their entireties by reference.

TECHNICAL FIELD

Aspects of the present disclosure are directed to a protective gloving configured to provide easy donning and/or doffing.

BACKGROUND OF THE DISCLOSURE

Gloves are known in the art to protect a wearer's hands from potentially damaging external environments. However, gloves currently known in the art require hand mobility in order for a wearer to don and/or doff the glove on one's own. There is thus a need in the art for a glove that may be donned and/or doffed by a wearer, including wearers having limited hand mobility.

BRIEF DESCRIPTION OF THE DISCLOSURE

Aspects of the present disclosure are directed to a protective glove comprising a palmar portion, a dorsal portion, one or more finger portions, a wrist portion, a fastening device, and/or one or more gripping devices. According to some aspects, the glove is configured to provide easy donning and/or doffing. Aspects of the present disclosure are also directed to methods of making the glove described herein and methods of using the same.

Additional advantages and novel features of these aspects will be set forth in part in the description that follows, and in part will become more apparent to those skilled in the art upon examination of the following or upon learning by practice of the disclosure.

BRIEF DESCRIPTION OF THE DRAWINGS

The accompanying drawings, which are incorporated into and constitute a part of this specification, illustrate one or more example aspects of the present disclosure and, together with the detailed description, serve to explain their principles and implementations.

DETAILED DESCRIPTION OF THE DISCLOSURE

Aspects of the present disclosure are directed to a protective glove comprising a palmar portion, a dorsal portion, one or more finger portions, a wrist portion, a fastening device, and/or one or more gripping devices. According to some aspects, the protective glove is configured to provide easy donning and/or doffing. Aspects of the present disclosure are also directed to methods of making the glove described herein and methods of using the same.

Figure 1B:
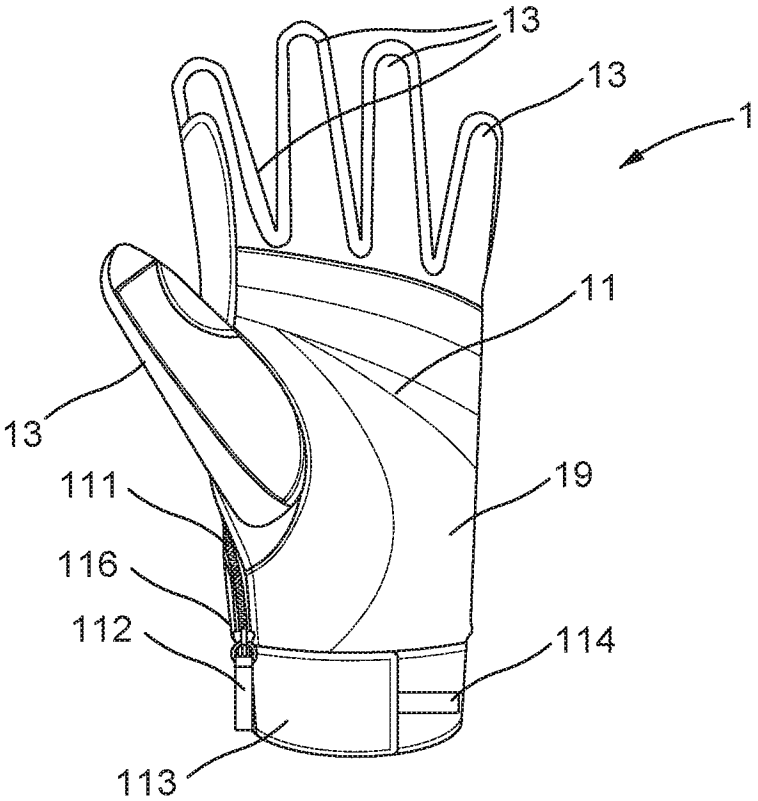
FIG. 1B shows a palmar view of an example glove according to aspects of the present disclosure.
Figure 1A:
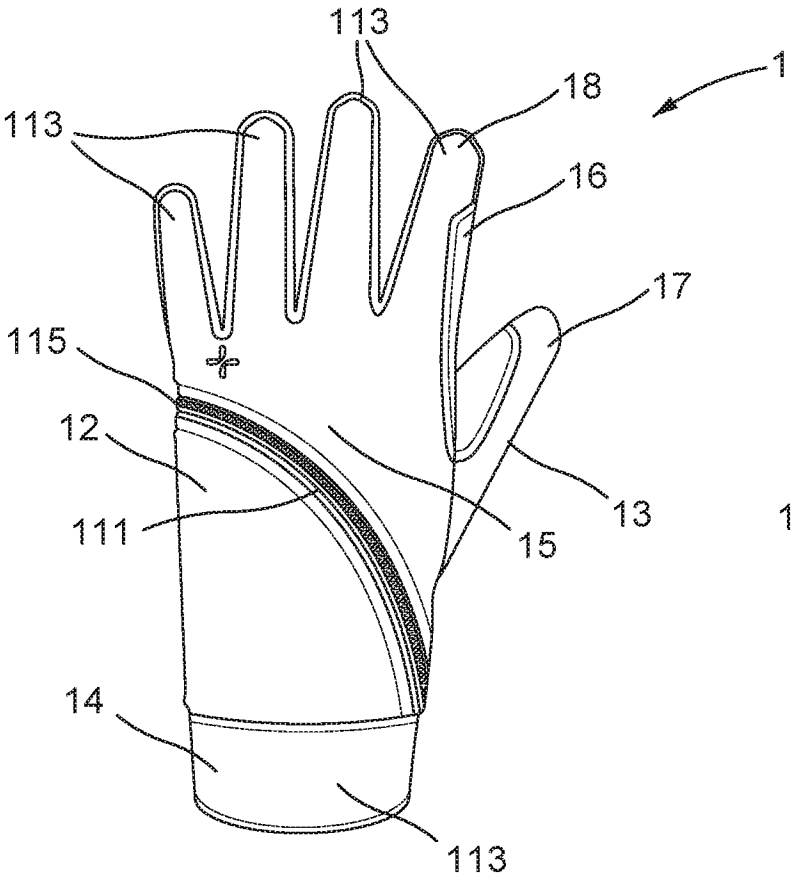
FIG. 1A shows a dorsal view of an example glove according to aspects of the present disclosure.

As used herein, the term "glove" refers to an article of clothing configured to be worn on a hand. As shown in FIGS. 1A and 1B, a glove 1 may comprise a palmar portion 11, that is, a portion of the glove 1 proximal the palm of a wearer's hand when the glove 1 is worn, and a dorsal portion 12, that is, a portion of the glove 1 proximal the dorsal side of a wearer's hand when the glove 1 is worn. The glove 1 may also comprise one or more finger portions 13, such as five finger portions 13 configured to protect each of a wearer's five fingers. It should be understood, however, that the number of finger portions 13 may be selected to provide any acceptable number of finger portions. For example, the one or more finger portions 13 may comprise two finger portions, such as a thumb portion configured to protect a wearer's thumb and a second finger portion configured to protect a wearer's remaining fingers (e.g., similar to a mitten). According to some aspects, the glove 1 may further comprise a wrist portion 14, that is, a portion of the glove 1 configured to protect a wearer's wrist.

According to some aspects, the palmar portion, the dorsal portion, the one or more finger portions, and/or the wrist portion may comprise one or more different materials.

For example, as shown in FIG. 1A, the dorsal portion 12 and/or the one or more finger portions 13 may comprise at least a first material 15 configured to protect the hand of a wearer (e.g., from environmental conditions) while also providing adequate functionality. As used herein, the term "adequate functionality" refers to the ability of a wearer to perform one or more functions while wearing the glove 1. Examples of the one or more functions include, but are not limited to, flexion of the fingers, extension of the fingers, use of technology (e.g., devices with touch screens), and combinations thereof. Example materials useful for the first material include, but are not limited to, conductive materials, neoprene, wool, cotton, leather, synthetic fibers, polyester, spandex, nylon, polyurethane, rubber, and combinations thereof.

As shown in FIG. 1A, the dorsal portion 12 and/or the one or more finger portions 13 may alternatively or additionally comprise a second material 16 that is different from the first material 15. According to some aspects, the second material 16 may also provide adequate functionality, as described herein. Alternatively or additionally, the second material 16 may provide adequate gripping. As used herein, the term "adequate gripping" refers to an acceptable level of friction provided by the material when in contact with a surface. According to some aspects, the acceptable level of friction may be a level of friction that is greater than the level of friction provided by the first material 15 when the first material 15 is in contact with the same surface. Example materials useful for the second material include, but are not limited to, polyester, spandex, nylon, polyurethane, rubber, wool, cotton, leather, synthetic fibers, and combinations thereof.

For example, as shown in FIG. 1A, at least two of the at least one finger portions 13 may comprise the second material 16. In this example, at least the thumb portion 17 and the forefinger portion 18 may comprise the second material, such that in use, when an object is gripped between the thumb and forefinger of a wearer, the acceptable level of friction is provided. For example, the glove 1 may be configured such that when a wearer operates a wheelchair, crutch, or other living aid, an acceptable level of friction is provided between the glove and the living aid, and thus, facilitated use of the living aid is provided to the wearer.

As shown in FIG. 1B, the palmar portion 11 of the glove 1 may comprise a third material 19. The third material may also provide adequate functionality and/or adequate gripping, as described herein. It should be understood that the third material 19 may be different from the first material 15 and/or the second material 16, or it may be the same as the first material 15 and/or the second material 16. In some aspects, the third material 19 is the same as or has similar properties to the second material 16 as described herein.

It should be understood that each of the palmar portion 11, the dorsal portion 12, and/or the one or more finger portions 13 may comprise the materials as described herein or may consist of the materials as described herein. For example, the palmar portion may comprise both the first material 15 and the third material 19, wherein the third material 19 is layered on the first material 15. In some example embodiments, each of the palmar portion 11, the dorsal portion 12, and/or the one or more finger portions 13 may each consist solely of the material as described herein, that is, such that there is no overlapping material other than the overlap necessary for attaching the glove portions to one another (e.g., via stitching).

According to some aspects, the glove 1 may further comprise a fastening device configured to be moved between an open position and a closed position (movement from the open position to the closed position and vice versa also being referred to herein as selective attaching and detaching, respectively). According to some aspects, the fastening device may separate one or more of the glove components into two or more section. For example, the fastening device may divide the dorsal portion into a first section and a second section. In particular, in the example shown in FIGS. 1A and 1B, the fastening device may divide the dorsal portion into a first section and a second section at an angle, that is, wherein the fastening device has a first point proximal a top corner 115 (FIG. 1A) (also interchangeably referred to herein as a "first corner") of the dorsal portion (e.g., near the one or more finger portions) and a second point 116 (FIG. 1B) proximal a bottom corner (also interchangeably referred to herein as a "second corner") of the dorsal portion and/or palmar portion (e.g., near the wrist portion). According to some aspects, the fastening device may be provided on more than one glove components. For example, the fastening device may at least partially wrap around the glove such that it contacts at least a portion of the dorsal portion and a portion of the palmar portion of the glove (for example, as shown in FIGS. 1A and 1B).

In the example shown in FIG. 1A, the fastening device 111 may comprise a zipper. However, it should be understood that any suitable fastener or features may be used in accordance with aspects of the present disclosure, so long as the fastening device may be moved between an open position and a closed position, and may function as described herein. Example fasteners include, but are not limited to, zippers, hook and loop fasteners (e.g., VELCRO®), and adhesives. As shown in FIG. 1A, at least a portion of the fastening device 111 (e.g., the path along which the pull tab of the zipper travels, or the teeth of the zipper) may be curved. Alternatively or additionally, the fastening device may comprise one or more straight portions.

According to some aspects, the fastening device 111 may be configured to provide easy donning and/or doffing of the glove 1. For example, according to some aspects, the glove 1 may be donned and/or doffed (i.e., put on and taken off, respectively) by a wearer who does not have full mobility of one or both hands. According to some aspects, easy donning and/or doffing of the glove 1 may be provided by moving the fastening device to an open position such that at least a portion of the glove 1 is placeable in an open, or generally planar configuration. It should be understood that one or more features of the fastening device 111 as described herein may be selected in order to maximize the beneficial effects thereof (e.g., providing easy donning and/or doffing).

Figure 5:
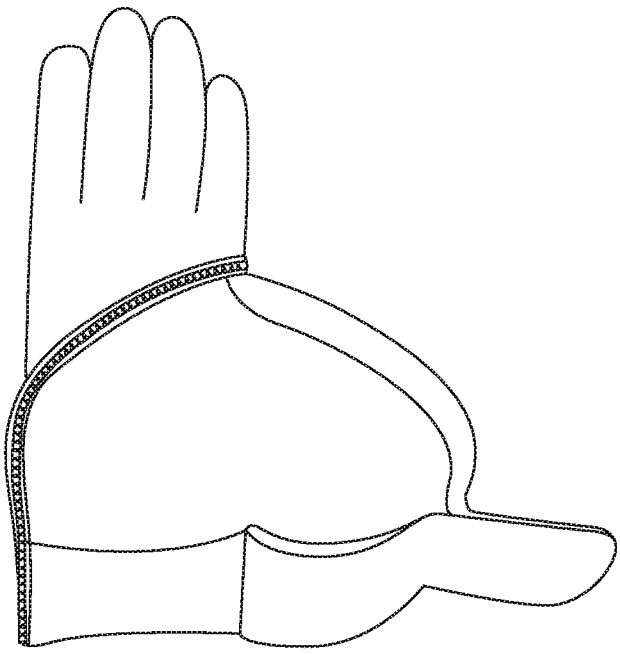
FIG. 5 shows a Photostat of an example glove in an open or generally planar configuration, in accordance with aspects of the present disclosure.

As used herein, the term "generally planar configuration" refers to a position wherein there is no overlap in material. For example, as shown in FIG. 5, at least a portion of the glove 1 (FIGS. 1A and 1B) may be provided in a generally planar configuration when the fastening device 111 (FIG. 1A) is provided in an open (e.g., unzipped) position. In this position, a portion of the palmar portion 11 (FIG. 1B) and a portion of the dorsal portion 12 (FIG. 1A) may not overlap such that both portions may contact one planar surface. In this way, donning and/or doffing of the glove 1 (FIGS. 1A and 1B) may be more easily provided. For example, donning the glove 1 of FIGS. 1A and 1B when in the position of FIG. 5 may comprise placing the glove 1 (FIGS. 1A and 1B) on a surface with the palmar portion 11 proximal the surface, positioning the fastening device 111 in an open position such that a portion of the glove is in a generally planar configuration, placing a wearer's hand onto the palmar portion 11, optionally closing a wrist portion 14 of the glove (as described herein), and positioning the fastening device 111 in a closed position such that the dorsal portion 12 is proximal (e.g., wrapped over) the dorsal portion of the wearer's hand. Doffing the glove 1 may comprise reversing these steps. In this way, the glove 1 may be donned and/or doffed without requiring the wearer to use, for example, a second hand to hold and/or pull at the glove 1 when donning and/or doffing the same.

According to some aspects, one or more features of the glove may further aid in easy donning and/or doffing thereof. In one example, the material used to provide adequate gripping may aid in donning and/or doffing of the glove. For example, as shown in FIG. 1B, the third material 19 comprised by the palmar portion 11 of the glove 1 may provide adequate gripping such that when the glove 1 is provided on a surface with the palmar portion 11 proximal the surface (e.g., as described herein), the third material 19 may inhibit or prevent movement of the glove 1, for example, when a wearer's hand is placed onto the palmar portion 11, as described herein.

Alternatively or additionally the glove may comprise one or more gripping devices (also referred to herein as a "gripping feature" or a "fastening device gripping feature" or a "wrist opening gripping feature"). As used herein, the term "gripping device" or "gripping feature" or "fastening device gripping feature" or a "wrist opening gripping feature" refers to a feature that aids in gripping of one or more portions of the glove (for example, the fastening device or wrist portion).

Figure 4:
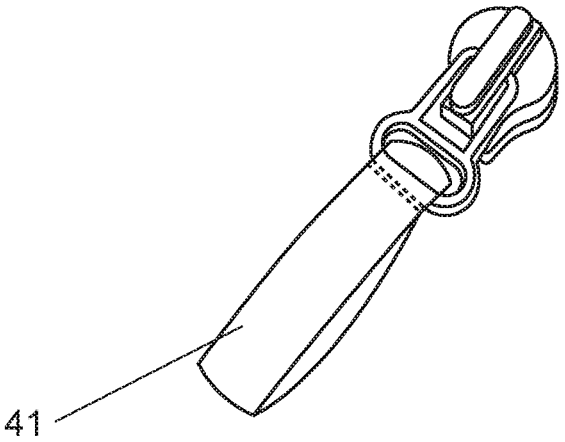
FIG. 4 shows a close up view of an example gripping feature according to aspects of the present disclosure.

For example, as shown in FIG. 1B, the glove 1 may comprise a gripping f 112 in communication with at least a portion of the fastening device 111 (e.g., in communication with the zipper). The gripping feature 112 may allow a wearer to more easily engage a portion of the fastening device 111 than would otherwise be possible without the gripping feature 112. For example, the gripping feature 112 may comprise a pull tab having a loop. In this way, even a wearer without full mobility of his or her hands may engage the fastening device 111 (e.g., by placing one or more fingers through the loop). Other example gripping devices include, but are not limited to, fabric hook and loop fasteners (e.g., VELCRO®), ropes, and bands (e.g., a plastic band). FIG. 4 shows a close up view of an example gripping feature 41 in communication with (e.g., attached to) a portion of a zipper.

According to some aspects, as shown in FIGS. 1A and 1B, the glove 1 may further comprise a wrist portion 14, that is, a portion proximal to a wearer's wrist when the glove 1 is worn. The wrist portion 14 may comprise a different material 113 than any of the materials described herein or it may comprise the same material as any of the materials described herein. According to some aspects, the wrist portion 14 may be selectively placed in either a closed position or an open position. For example, the wrist portion 14 may be placed in an open position to allow donning and/or doffing of the glove 1, and may be placed in a closed position to secure the glove 1 or to protect a portion of the wearer (e.g., the wearer's wrist) when the glove 1 is worn. According to some aspects, the wrist portion 14 may comprise one or more features to secure the wrist portion 14 in the closed position (e.g., a hook and loop fastener, an adhesive, and combinations thereof) and/or may comprise a gripping feature 114 similar to gripping feature 112, which may aid in moving the wrist portion 14 between the closed and open positions.

Figure 2A:
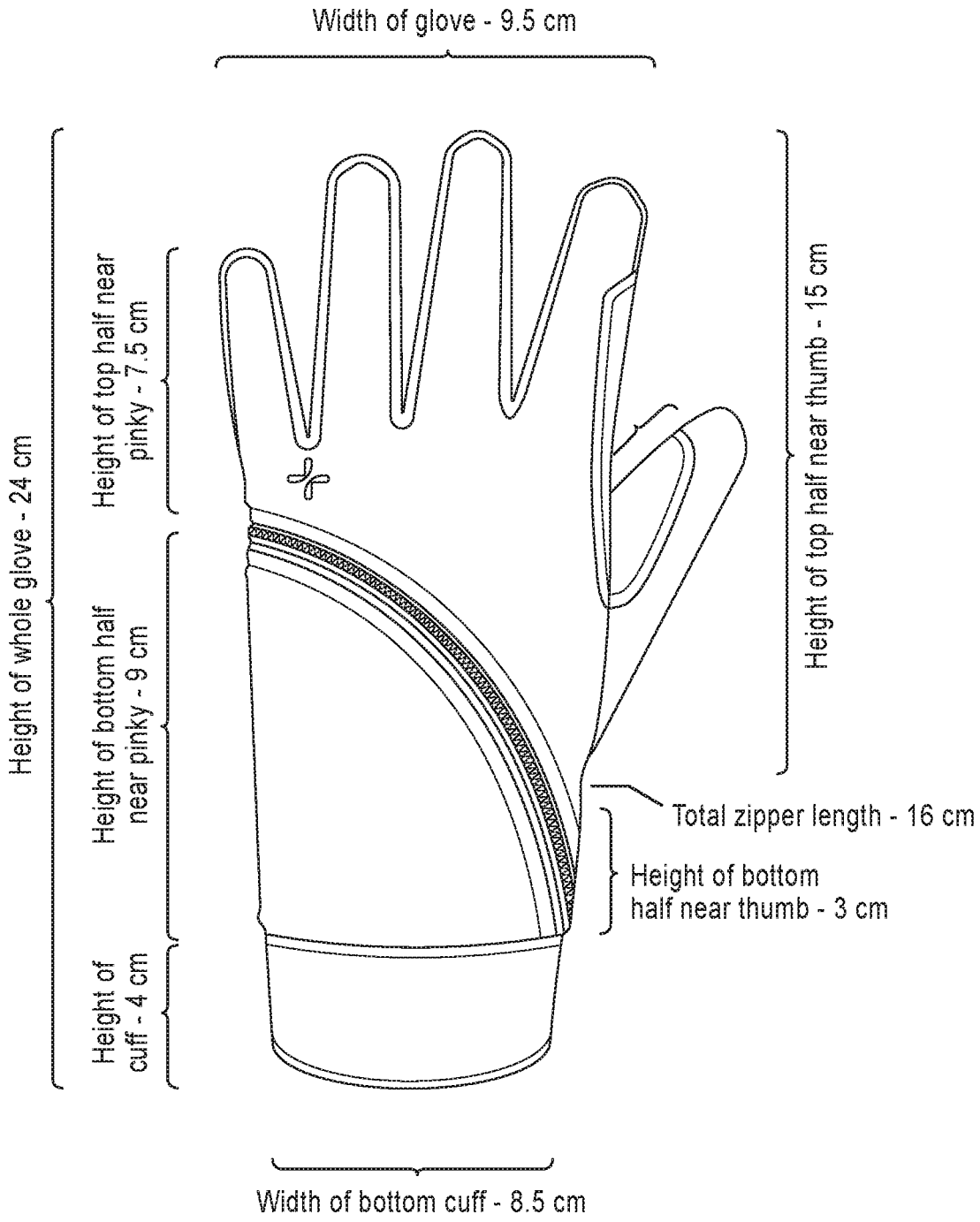
FIG. 2A shows a dorsal view of an example glove according to aspects of the present disclosure with example dimensions.

FIG. 2A shows a dorsal view of an example glove according to aspects of the present disclosure with example dimensions.

Figure 2B:
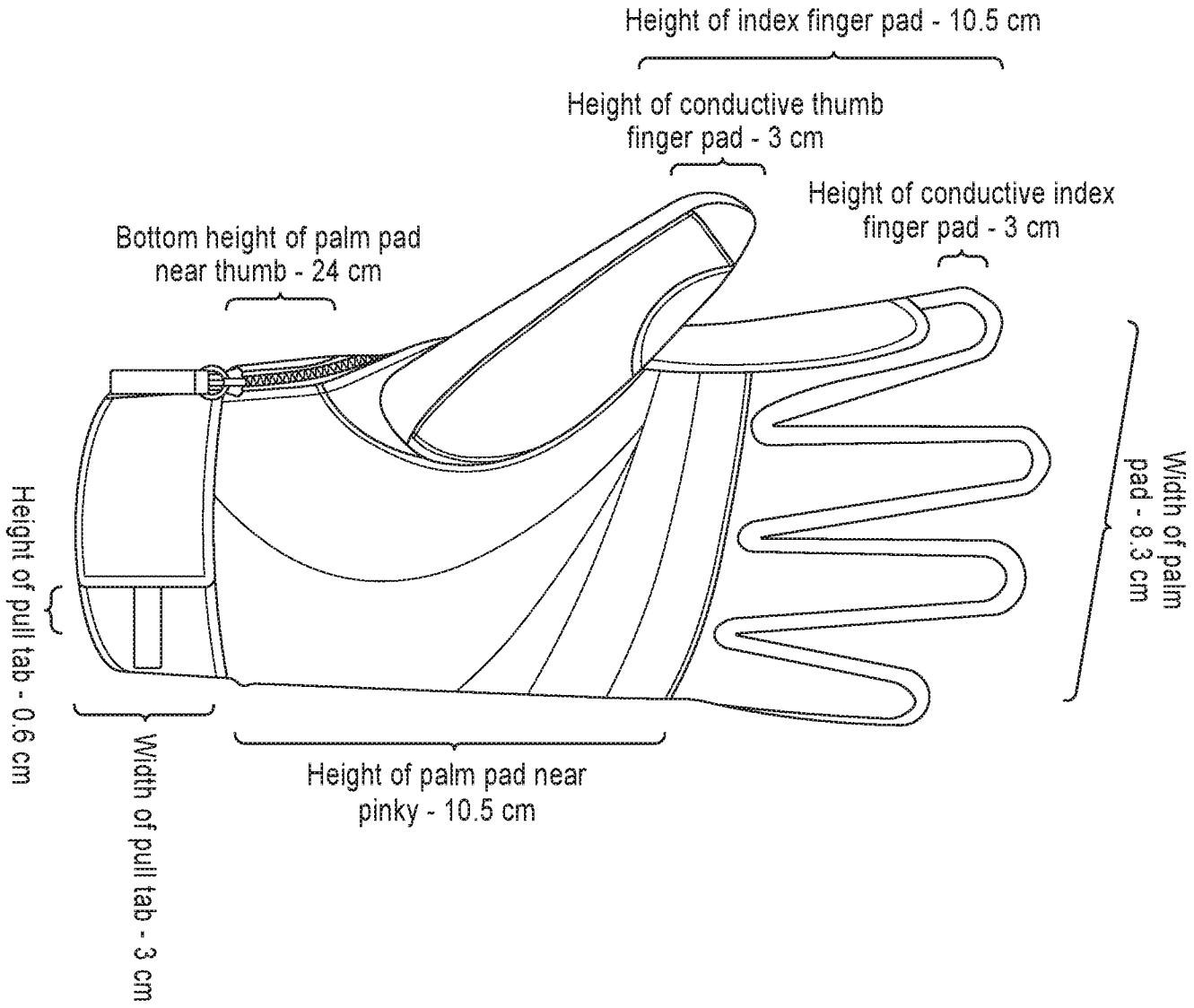
FIG. 2B shows a palmar view of an example glove according to aspects of the present disclosure with example dimensions.

FIG. 2B shows a palmar view of an example glove according to aspects of the present disclosure with example dimensions.

Figure 3A:
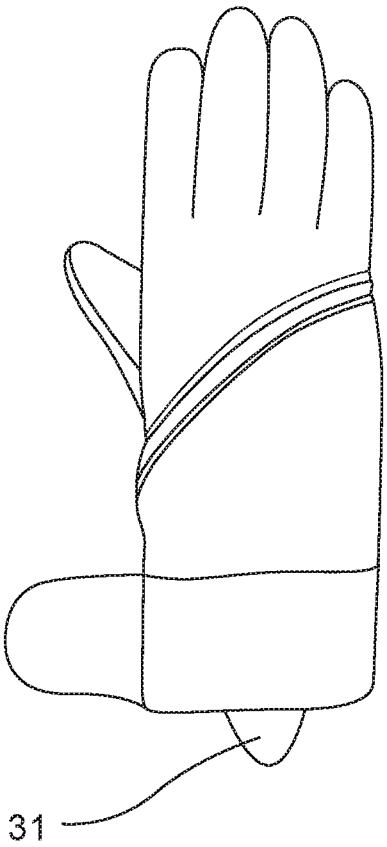
FIG. 3A shows a Photostat of a dorsal view of an example glove according to aspects of the present disclosure.

FIG. 3A shows a Photostat of a dorsal view of an example glove according to aspects of the present disclosure.

Figure 3B:
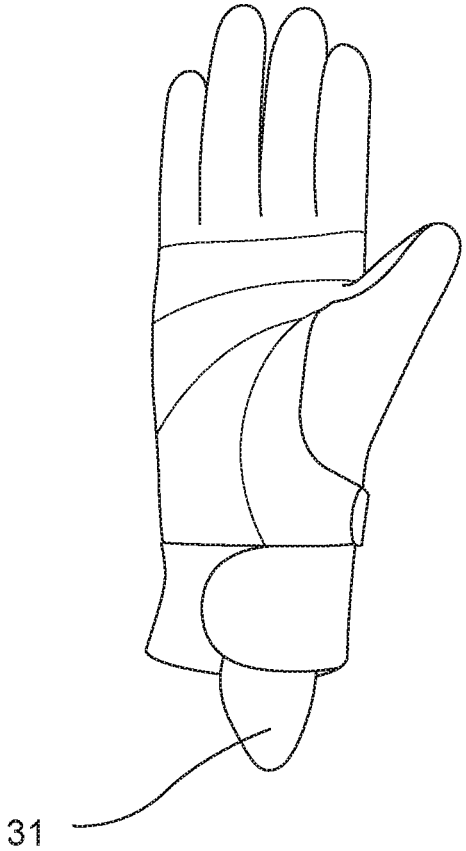
FIG. 3B shows a Photostat of a palmar view of an example glove according to aspects of the present disclosure.

FIG. 3B shows a Photostat of a palmar view of an example glove according to aspects of the present disclosure.

FIG. 5 shows a Photostat of an example glove, such as the glove of FIGS. 3A and 3B, placed in an open or generally planar configuration, in accordance with aspects of the present disclosure.

Aspects of the present disclosure are also directed to methods of making and using the glove as described herein.

While the aspects described herein have been described in conjunction with the example aspects outlined above, various alternatives, modifications, variations, improvements, and/or substantial equivalents, whether known or that are or may be presently unforeseen, may become apparent to those having at least ordinary skill in the art. Accordingly, the example aspects, as set forth above, are intended to be illustrative, not limiting. Various changes may be made without departing from the spirit and scope of the disclosure. Therefore, the disclosure is intended to embrace all known or later-developed alternatives, modifications, variations, improvements, and/or substantial equivalents.

Thus, the claims are not intended to be limited to the aspects shown herein, but are to be accorded the full scope consistent with the language of the claims, where reference to an element in the singular is not intended to mean "one and only one" unless specifically so stated, but rather "one or more." All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed as a means plus function unless the element is expressly recited using the phrase "means for."

Further, the word "example" is used herein to mean "serving as an example, instance, or illustration." Any aspect described herein as "example" is not necessarily to be construed as preferred or advantageous over other aspects. Unless specifically stated otherwise, the term "some" refers to one or more. Combinations such as "at least one of A, B, or C," "at least one of A, B, and C," and "A, B, C, or any combination thereof" include any combination of A, B, and/or C, and may include multiples of A, multiples of B, or multiples of C. Specifically, combinations such as "at least one of A, B, or C," "at least one of A, B, and C," and "A, B, C, or any combination thereof" may be A only, B only, C only, A and B, A and C, B and C, or A and B and C, where any such combinations may contain one or more member or members of A, B, or C. Nothing disclosed herein is intended to be dedicated to the public regardless of whether such disclosure is explicitly recited in the claims.

The word "about" is used herein to mean within ±5% of the stated value, optionally within ±4%, optionally within ±3%, optionally within ±2%, optionally within ±1%, optionally within ±0.5%, optionally within ±0.1%, and optionally within ±0.01%.

The invention claimed is:

1. A glove, comprising:

a dorsal portion, the dorsal portion comprising a first material divided into a first and a second section, the dorsal portion further including:

a fastening device for selectively attaching and detaching the first and second sections of the dorsal portion; and a fastening device gripping feature attached to the fastening device, wherein: the fastening device is a zipper, the zipper comprising a first pull tab configured to travel along a path formed by a plurality of teeth, the fastening device divides the dorsal portion into the first and second sections at an angle, the fastening device comprises a first point on the path closest to a finger portion, and a second point on the path closest to a wrist portion, the fastening device is configured to be provided in at least an open position and a closed position, the glove having a generally planar configuration when the fastening device is provided in the open position, the first pull tab is configured to travel along the path continuously downward from the finger portion to the wrist portion and the path extends continuously arcuately from the open position to the closed position, the path curving continuously arcuately from the first point to the second point, and the first pull tab is at the second point in the closed position; a palmar portion, the palmar portion including:

at least a section comprising a second material; and the wrist portion attached to the dorsal portion and the palmar portion, wherein the wrist portion is selectively movable between an open and a closed position about a wearer's wrist, the wrist portion further including:

a wrist opening gripping feature.

2. The glove of claim 1, wherein the wrist portion comprises a hook and loop surface.

3. The glove of claim 2, wherein the wrist opening gripping feature comprises a third pull tab having a loop.

4. The glove of claim 1, wherein the fastening device is provided on at least a portion of the palmar portion.

5. The glove of claim 1, wherein the fastening device gripping feature comprises a second pull tab having a loop.

6. The glove of claim 1, wherein the first material is selected from the group consisting of conductive materials, neoprene, wool, cotton, leather, synthetic fibers, polyester, spandex, nylon, polyurethane, rubber, and combinations thereof.

7. The glove of claim 1, wherein the second material is selected from the group consisting of polyester, spandex, nylon, polyurethane, rubber, wool, cotton, leather, synthetic fibers, and combinations thereof.

8. The glove of claim 1, wherein the first material is different from the second material.

9. The glove of claim 8, wherein the first material provides a first level of friction when in contact with a surface, and wherein the second material provides a second level of friction when in contact with the surface, the second level of friction being greater than the first level of friction.

10. The glove of claim 1 further comprising a third material, the third material being different from the first material and the second material.

11. A method of donning the glove according to claim 1, the method comprising:

placing a wearer's hand into the palmar portion of the glove while the glove is on a surface in the generally planar configuration, and moving the fastening device to a closed position such that a dorsal side of the wearer's hand is proximal the dorsal portion.

12. The method of claim 11, further comprising:

moving the wrist portion to the closed position after the wearer's hand is provided on the palmar portion.

13. The method of claim 11, wherein the fastening device gripping feature comprises a pull tab having a loop.

14. The method of claim 11, wherein the wrist portion comprises a hook and loop surface.

15. The method of claim 14, wherein the wrist opening gripping feature comprises a pull tab having a loop.

* * * * *